US007059643B1

(12) United States Patent
Ghent

(10) Patent No.: US 7,059,643 B1
(45) Date of Patent: Jun. 13, 2006

(54) SNOW SHOVEL CONSTRUCTION

(76) Inventor: Gina S. Ghent, 5 Midland Gardens, #4G, Bronxville, NY (US) 10708

( * ) Notice: Subject to any disclaimer, the term of this patent is extended or adjusted under 35 U.S.C. 154(b) by 0 days.

(21) Appl. No.: 10/916,062

(22) Filed: Aug. 11, 2004

(51) Int. Cl.
*E01H 5/02* (2006.01)

(52) U.S. Cl. ..... 294/60; 294/54.5

(58) Field of Classification Search ..... 294/49, 294/50, 59, 60, 54.5; 37/265, 284, 285; 254/131.5; 172/371
See application file for complete search history.

(56) References Cited

U.S. PATENT DOCUMENTS

| | | | | |
|---|---|---|---|---|
| 1,658,963 | A * | 2/1928 | Bergquist | 294/60 |
| 3,035,816 | A * | 5/1962 | Conant | 254/131.5 |
| 3,078,604 | A | 2/1963 | Neuman | 37/53 |
| 4,214,385 | A | 7/1980 | Baranowski et al. | 37/130 |
| 4,516,799 | A * | 5/1985 | O'Donnell | 294/54.5 |
| 5,054,830 | A | 10/1991 | Nisenbaum | 294/58 |
| 5,085,478 | A * | 2/1992 | Seifert et al. | 294/60 |
| 5,271,169 | A * | 12/1993 | Konsztowicz | 37/271 |
| 5,503,445 | A * | 4/1996 | Fontaine | 294/60 |
| 5,732,933 | A | 3/1998 | Champi | 254/131.5 |
| D395,212 | S | 6/1998 | Vosbikian | D8/10 |

* cited by examiner

*Primary Examiner*—Dean J. Kramer
(74) *Attorney, Agent, or Firm*—Sturm & Fix LLP

(57) ABSTRACT

An improved snow shovel construction (10) (10') (10") for a snow shovel blade member (20) having a front face 22 and a rear surface (21) wherein, the snow shovel blade member (20) is connected to a handle member (27) and the improvement includes a foot receiving recess member (30) (40) and (50) operatively associated with the rear surface (21) of the shovel blade member (20) and having a high friction surface (31) (41) and (51) respectively that is engageable by the toe portion of a user's footwear (100).

8 Claims, 2 Drawing Sheets

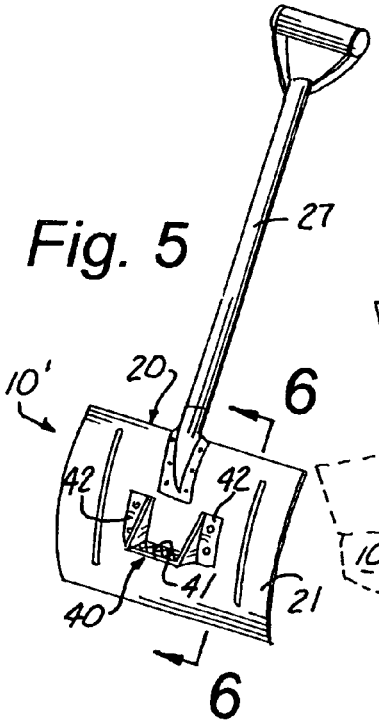
Fig. 5
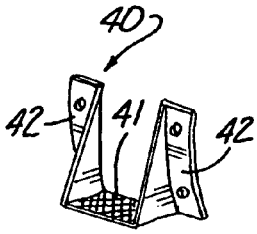
Fig. 7
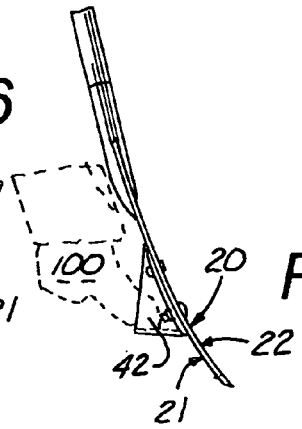
Fig. 6
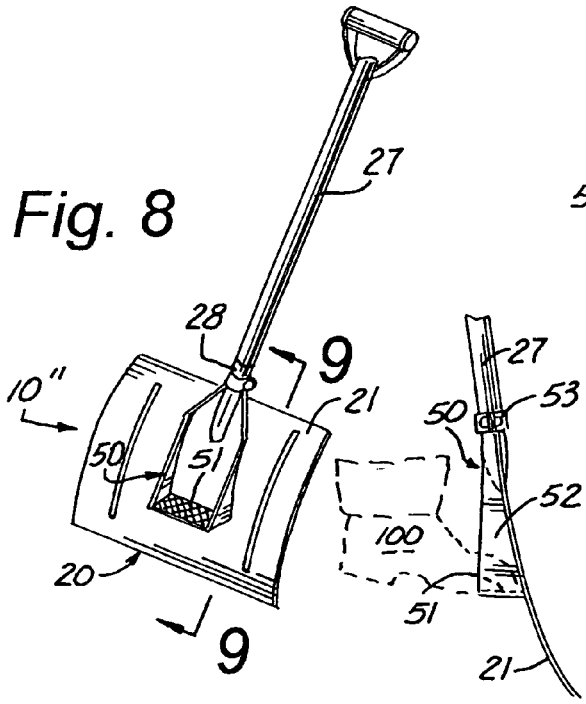
Fig. 8
Fig. 9
Fig. 10
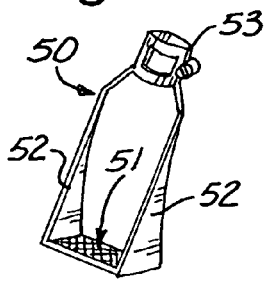

SNOW SHOVEL CONSTRUCTION

CROSS REFERENCE TO RELATED APPLICATIONS

Not applicable.

BACKGROUND OF THE INVENTION

1. Field of the Invention

The present invention relates to the field of snow shovel constructions in general and in particular to a snow shovel construction for facilitating the dumping of a full load of snow from the front of the shovel face.

2. Description of Related Art

As can be seen by reference to the following U.S. Pat. Nos. 5,732,933; 5,054,830; 4,214,385; 3,078,604; Des. 395, 212, the prior art is replete with myriad and diverse specialized snow shovel constructions.

While all of the aforementioned prior art constructions are more than adequate for the basic purpose and function for which they have been specifically designed, they are uniformly deficient with respect to their failure to provide a simple, efficient, and practical snow shovel construction that incorporates a foot assist feature operatively associated with the rear face of the shovel for unloading snow from the front face of the shovel.

As anyone who has had the unpleasant task of shoveling wet, sticky, or slushy snow is all too well aware, one of the more difficult aspects of this task is the removal of the accumulated sticky snow from the front face of the shovel which usually entails banging the sides or bottom of the shovel against a hard surface to dislodge the snow.

As a consequence of the foregoing situation, there has existed a longstanding need among owners of snow shovels for a new and improved snow shovel construction that provides a foot bearing surface on the rear face of the shovel to facilitate the removal of snow from the front face of the shovel and the provision of such a construction is the stated objective of the present invention.

BRIEF SUMMARY OF THE INVENTION

Briefly stated, the snow shovel construction that forms the basis of the present invention comprises three different versions that all share a common structural feature in that a foot assist member is operatively associated with the rear face of a shovel construction to facilitate the dislodging of sticky snow from the front face of the shovel without resorting to banging the bottom and/or sides of the shovel against a hard surface.

As will be explained in greater detail further on in the specification, in the first version of the preferred embodiment, a foot receiving recess is formed integrally with the shovel blade and, in the second and third versions of the preferred embodiment, a foot receiving member is affixed respectively to the rear of the shovel blade or suspended from the shovel handle adjacent to the rear of the shovel blade.

It should be noted that in all three versions of the shovel construction, the user can insert their foot into the foot assist member on the rear face of the shovel member to transfer force through the thickness of the shovel to dislodge snow from the front face of the shovel member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 5 is a rear perspective view of the bolt-on bracket version of the invention;

FIG. 6 is a view of the bolt-on bracket on the rear of the shovel blade taken through line 6—6 of FIG. 5;

FIG. 7 is an isolated perspective view of the bolt-on bracket;

FIG. 8 is a rear perspective view of the handle supported version of the invention;

FIG. 9 is a cross-sectional view taken through line 9—9 of FIG. 8 showing the user's foot inserted into the foot receiving member of the handle supported version of the invention; and, FIG. 10 is an isolated perspective view of the handle supported foot recess member.

DETAILED DESCRIPTION OF THE INVENTION

Figure 1:
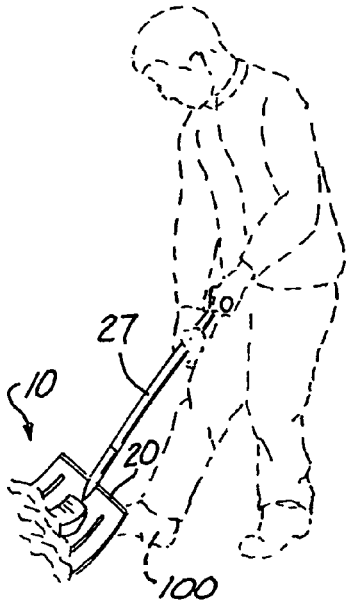
FIG. 1 is a perspective view of the integrally formed version of the snow shovel construction in use.
Figure 2:
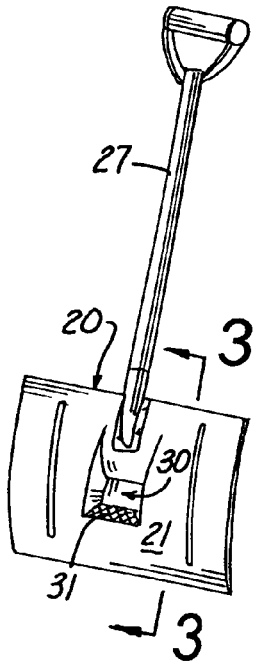
FIG. 2 is a rear perspective view of the integrally formed version of the snow shovel construction.
Figure 3:
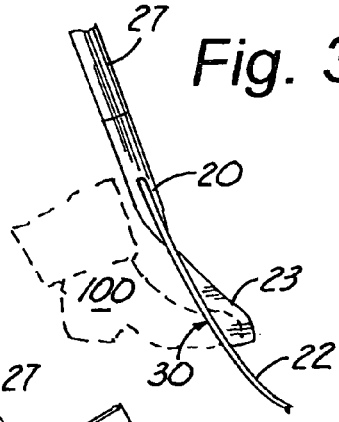
FIG. 3 is a cross-sectional view taken through line 3—3 of FIG. 2 showing the user's foot inserted into the recessed rear of the snow shovel blade.
Figure 4:
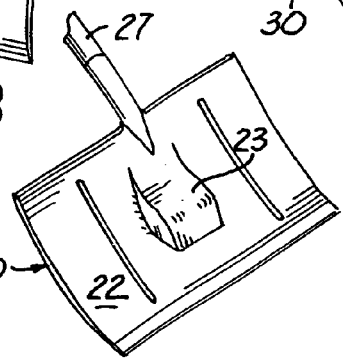
FIG. 4 is an isolated front perspective view of the integrally formed version of the snow shovel construction.

As can be seen by reference to the drawings, and in particular to FIGS. 1 through 4, the first version of the preferred embodiment of the snow shovel construction that forms the basis of the present invention is designated generally by the reference number 10. In this version of the snow shovel construction 10 a foot receiving recess member 30 is formed integrally in the rear surface 21 of a snow shovel blade member 20 provided with a handle member 27 wherein, the foot receiving recess member 30 forms a bulge 23 in the front face 22 of the shovel blade member 20.

In addition, the bottom portion of the integrally formed foot receiving recess member 30 is further provided with a high friction surface 31 adapted to be engaged by the toe portion of the user's footwear 100 as the user employs one of their feet as a lever to lift the blade member 20 when it is full of snow and/or as an impact transmitting medium to free sticky snow from the front face 22.

Turning now to FIGS. 5 through 7, it can be seen that in the second version of the preferred embodiment of the shovel construction 10' the foot receiving recess member is designated generally as 40 and comprises a generally U-shaped bracket member 40 having a high friction surface 41 disposed intermediate a pair of wedge shaped bracket arms 42 that are secured by conventional securing means such as bolts, welds, space age adhesives, etc., to the rear surface 21 of the shovel blade member 20 such that the high friction surface 41 is disposed generally parallel to the ground when the shovel blade member 20 is disposed at an angle of approximately 45° relative to the ground.

In this particular version, the shovel blade member 20 will have a conventional configuration with no protrusion on its front surface 22 due to the fact that the foot receiving recess member 40 is affixed directly to the rear surface 21 of the shovel blade member 20.

In the third version of the preferred embodiment of the shovel construction 10" depicted in FIGS. 8 through 10, the foot receiving recess member is designated generally as 50 and, as in the case of the other foot receiving members 30 and 40 previously described, is likewise provided with a generally flat high friction surface 51 which is suspended between a pair of wedge shaped support arms 52 that are operatively connected to a collar element 53.

The collar element 53 is further adapted to be releasably connected to either the shovel handle receptacle 28 or the handle member 51 adjacent the midpoint of the rear surface 21 of the shovel blade member 20.

By now it should be appreciated that in all three versions of the preferred embodiment of the snow shovel construction 10 10' 10" there is a generally flat, high friction surface 31 41 and 51 associated with each version of the foot recess member 30 40 and 50 respectively, that allows the user to apply force to the rear surface 21 of the shovel blade member 20 to either accumulate and/or dislodge snow relative to the front face 22 of the shovel blade member 20.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An improved snow shovel construction for a snow shovel comprising a handle member connected to a shovel blade member having a front face and a rear surface wherein, the improvement comprises:

foot receiving recess member operatively associated with the rear surface of the shovel blade member and having a high friction surface that is disposed below the handle member and generally parallel to the ground when the shovel blade member is disposed at an angle of approximately 45° relative to the ground; and wherein, said foot receiving recess member is formed integrally with said shovel blade member.

2. The construction as in claim 1; wherein, said foot receiving recess member forms a protrusion on the front face of the shovel blade member.

3. An improved slow shovel construction for a snow shovel comprising a handle member connected to a shovel blade member having a front face and a rear surface wherein, the improvement comprises:

foot receiving recess member operatively associated with the rear surface of the shovel blade member and having a high friction surface that is disposed below the handle member and generally parallel to the ground when the shovel blade member is disposed at an angle of approximately 45° relative to the ground; and wherein, said foot receiving recess member is secured directly to the rear surface of the shovel blade member;

wherein, the foot receiving recess member comprises a generally U-shaped bracket member;

wherein, the U-shaped bracket member has a pair of bracket arms connected to one another by the high friction surface; and wherein, said bracket arms are directly connected to the rear surface of the shovel blade member.

4. The construct as in claim 3; wherein, said bracket arms are generally wedge shaped.

5. An improved snow shovel construction for a snow shovel comprising a handle member connected to a shovel blade member having a front face and a rear surface wherein, the improvement comprises:

foot receiving recess member operatively associated with the rear surface of the shovel blade member and having a high friction surface that is disposed below the handle member and generally parallel to the ground when the shovel blade member is disposed at an angle of approximately 45° relative to the ground; and wherein, the foot receiving recess member is suspended from the handle member of the snow shovel construction.

6. The construction as in claim 5; wherein, the foot receiving recess member includes the high friction surface that is suspended from a pair of support arms that are operatively connected to a collar element that is adapted to engage the handle member of the snow shovel construction.

7. The construction as in claim 6; wherein, said support arms are wedge shaped.

8. An improved snow shovel construction for a snow shovel comprising a handle member connected to a shovel blade member having a front face and a rear surface wherein, the improvement comprises:

foot receiving recess member operatively associated with the rear surface of the shovel blade member and having a high friction surface that is disposed below the handle member and generally parallel to the ground when the shovel blade member is disposed at an angle of approximately 45° relative to the ground; and wherein the shovel blade member has a top and bottom and the foot receiving recess member is disposed between the top and the bottom of the shovel blade member.

* * * * *